US009480872B2

(12) United States Patent
Attalah

(10) Patent No.: US 9,480,872 B2
(45) Date of Patent: Nov. 1, 2016

(54) EXERCISE AID

(71) Applicant: Omar Attalah, Los Angeles, CA (US)

(72) Inventor: Omar Attalah, Los Angeles, CA (US)

( * ) Notice: Subject to any disclaimer, the term of this patent is extended or adjusted under 35 U.S.C. 154(b) by 272 days.

(21) Appl. No.: 14/183,657

(22) Filed: Feb. 19, 2014

(65) Prior Publication Data

US 2014/0249004 A1 Sep. 4, 2014

Related U.S. Application Data

(60) Provisional application No. 61/771,696, filed on Mar. 1, 2013.

(51) Int. Cl.

| | |
|---|---|
| ***A63B 23/02*** | (2006.01) |
| ***A63B 21/05*** | (2006.01) |
| ***A63B 21/00*** | (2006.01) |
| ***A63B 21/008*** | (2006.01) |
| ***A63B 21/02*** | (2006.01) |
| ***A63B 21/04*** | (2006.01) |

(52) U.S. Cl.

CPC ..... *A63B 21/05* (2013.01); *A63B 21/0004* (2013.01); *A63B 21/00069* (2013.01); *A63B 21/0087* (2013.01); *A63B 21/023* (2013.01); *A63B 21/028* (2013.01); *A63B 21/0414* (2013.01); *A63B 21/4035* (2015.10); *A63B 23/02* (2013.01)

(58) Field of Classification Search

CPC ..... A63B 21/05; A63B 21/0069; A63B 21/0087; A63B 21/023; A63B 21/0414; A63B 21/0428; A63B 23/0211; A63B 23/0216; A63B 23/0222

See application file for complete search history.

(56) References Cited

U.S. PATENT DOCUMENTS

| | | | | |
|---|---|---|---|---|
| 4,842,273 | A * | 6/1989 | Schmeiss | A63B 21/022 482/126 |
| 5,046,726 | A * | 9/1991 | Van Straaten | A63B 21/4045 482/125 |
| 5,913,756 | A * | 6/1999 | Glaser | A63B 21/05 482/125 |
| 6,056,676 | A * | 5/2000 | Adams | A63B 21/0004 482/112 |
| 6,712,742 | B2 * | 3/2004 | Suiter | A63B 21/0004 482/140 |
| 6,964,636 | B2 * | 11/2005 | Verheem | A63B 21/05 482/121 |
| 7,101,328 | B2 * | 9/2006 | Chiu | A63B 21/0004 482/140 |
| 7,789,815 | B2 * | 9/2010 | An | A63B 21/0004 482/126 |
| 9,238,157 | B2 * | 1/2016 | Chuang | A63B 21/055 |
| 2013/0005542 | A1 * | 1/2013 | Wu | A63B 21/05 482/128 |

* cited by examiner

*Primary Examiner* — Joshua Kennedy

(74) *Attorney, Agent, or Firm* — Kafantaris Law Office; Theo Kanfantaris

(57) ABSTRACT

A device is disclosed which is more effective and efficient than the traditional sit-up, but does not include the inherent negative side effects. Moreover, the device is intuitive to use, will have increased efficiency, and can be used in a variety of ways. The device is made of a plurality of components, including: a pair of tube housings, a plurality of compression mechanism, a plurality of height-adjustment mechanisms, a width-adjustment mechanism, and a plurality of grips. These components work in conjunction to form an abdominal exercise machine that is more safe and efficient than traditional abdominal exercises.

20 Claims, 7 Drawing Sheets

EXERCISE AID

CROSS-REFERENCE TO RELATED APPLICATIONS

This application claims the benefit of U.S. Provisional Patent Application No. 61/771,696, filed on Mar. 1, 2013, and incorporated herein by reference.

STATEMENT REGARDING FEDERALLY SPONSORED RESEARCH AND DEVELOPMENT

Not Applicable.

FIELD OF THE INVENTION

This invention relates generally to an exercise aid, and more particularly, to an apparatus which is positioned between the chest and the legs for use in developing muscular fitness.

DISCUSSION OF RELATED ART

Physical exercise can generally be described as a physical activity for maintaining physical fitness, boosting cardiovascular health, promoting weight loss, sharpening athletic skills, reducing stress, or improving one's general well-being. Aerobic exercise, also colloquially known as cardio, is a low intensity type of physical exercise used to expel the energy of the body and burn fat. Conversely, anaerobic exercise is a type of physical exercise where the intensity is magnified to trigger anaerobic metabolism, which builds muscle mass.

Physical exercise, especially anaerobic exercise, often includes the use of exercise machines for increased efficiency. Typically, exercise machines provide resistance to the user for weight training, where gravitational or resistive forces are utilized by the user through pulleys, levers, wheels, and other simple mechanical devices. Exercise machines commonly include a means for adjusting the amount of force or resistance desired, typically through placing a pin through a plurality of labeled apertures or by adjusting a mechanism to do the same.

Abdominal exercise is used to build abdominal muscles, where users typically place increased importance due to societal demands. The most common type of abdominal exercise is the sit-up, or crunch, where the user rests on their back with their knees bent and their hands on the back of their head. The user will then curl their shoulders towards their pelvis and return to the floor, completing one of a plurality of sit-ups. While this exercise is indeed effective, it is also commonly associated with neck and back strain, and many physical trainers encourage alternative techniques for abdominal exercises.

While several devices for weight training are currently available, there is a void in the area of abdominal exercise, where users often resort to bizarre devices which promise results but seldom deliver. Therefore, a need exists for a device which is more effective and efficient than the traditional sit-up, but does not include the inherent negative side effects. The present invention satisfies these needs.

SUMMARY OF THE INVENTION

The present invention will provide a device which is more effective and efficient than the traditional sit-up, but does not include the inherent negative side effects. Moreover, the present invention will be intuitive to use, will have increased efficiency, and will not have the negative side effects of the traditional sit-up exercise.

The present invention is comprised of a plurality of components, including: a pair of tube housings, a plurality of compression mechanism, a plurality of height-adjustment mechanisms, a width-adjustment mechanism, and a plurality of grips. These components work in conjunction to provide an abdominal exercise machine that is intuitive, safe, and more efficient than traditional abdominal exercises.

These and other objectives of the present invention will become obvious to those of ordinary skill in the art after reading the following detailed description of the preferred embodiments. It is to be understood that the foregoing general description and the following detailed description are exemplary, and are intended to provide further explanation of the invention as claimed.

DETAILED DESCRIPTION OF THE PREFERRED EMBODIMENT

Figure 1:
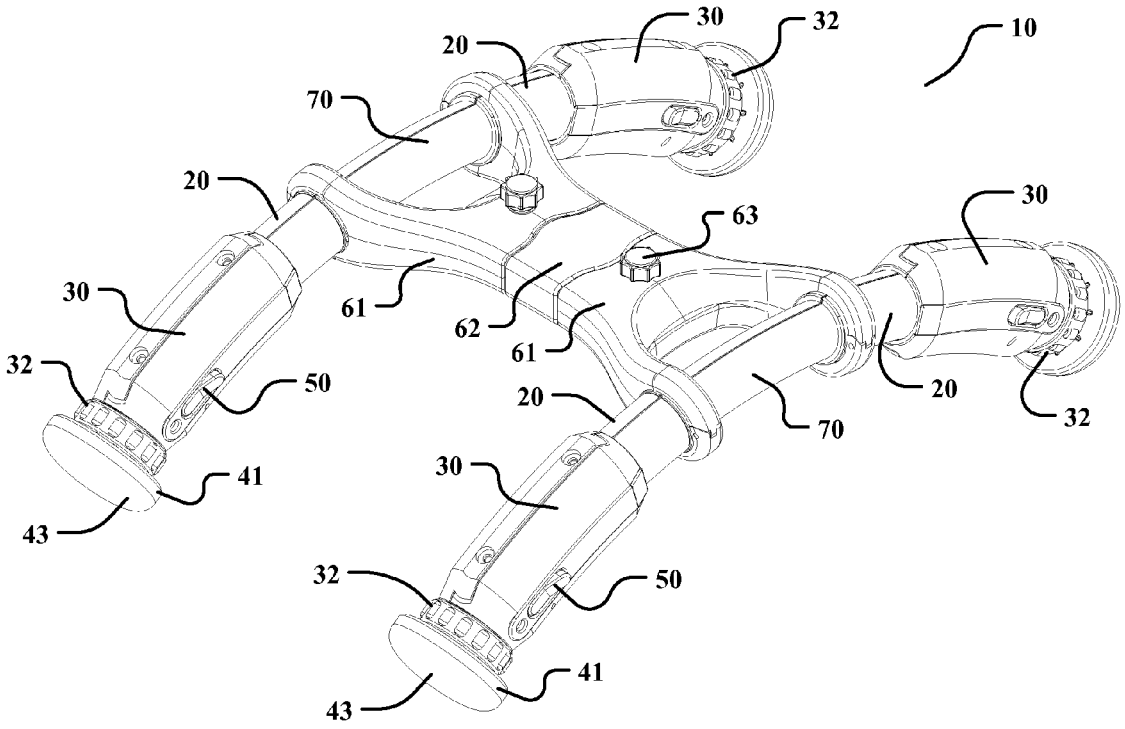
FIG. 1 is a diagram illustrating a front perspective view of the exercise aid according to one embodiment of the invention.
Figure 2:
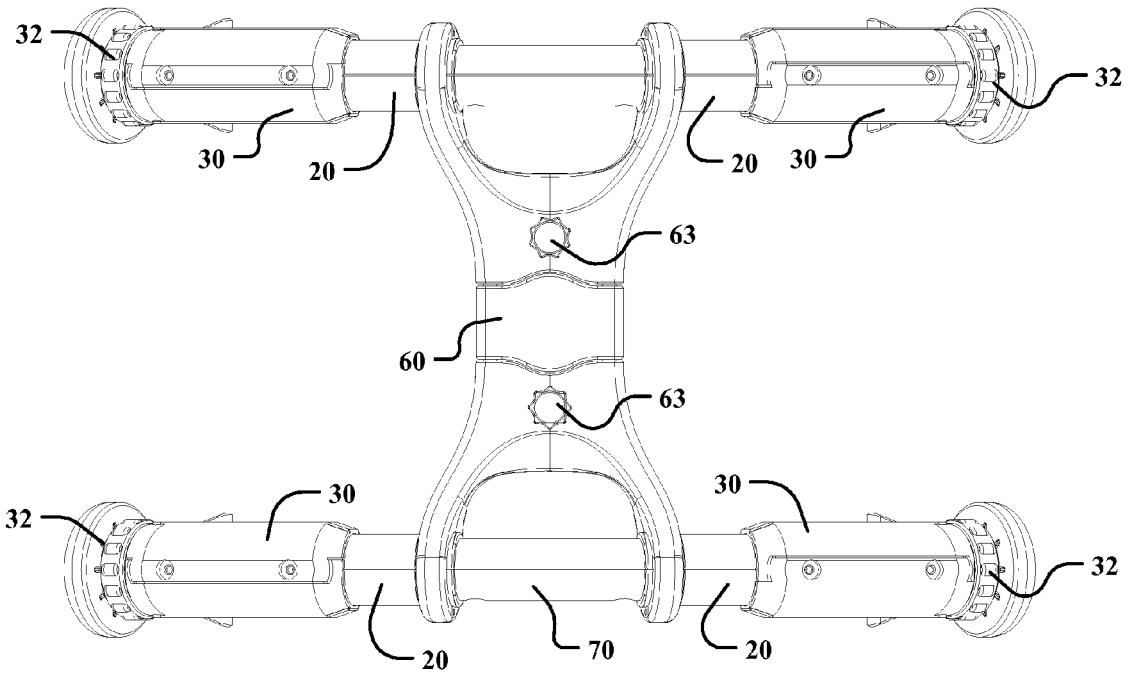
FIG. 2 is a diagram illustrating a top view of the exercise aid according to one embodiment of the invention.
Figure 3:
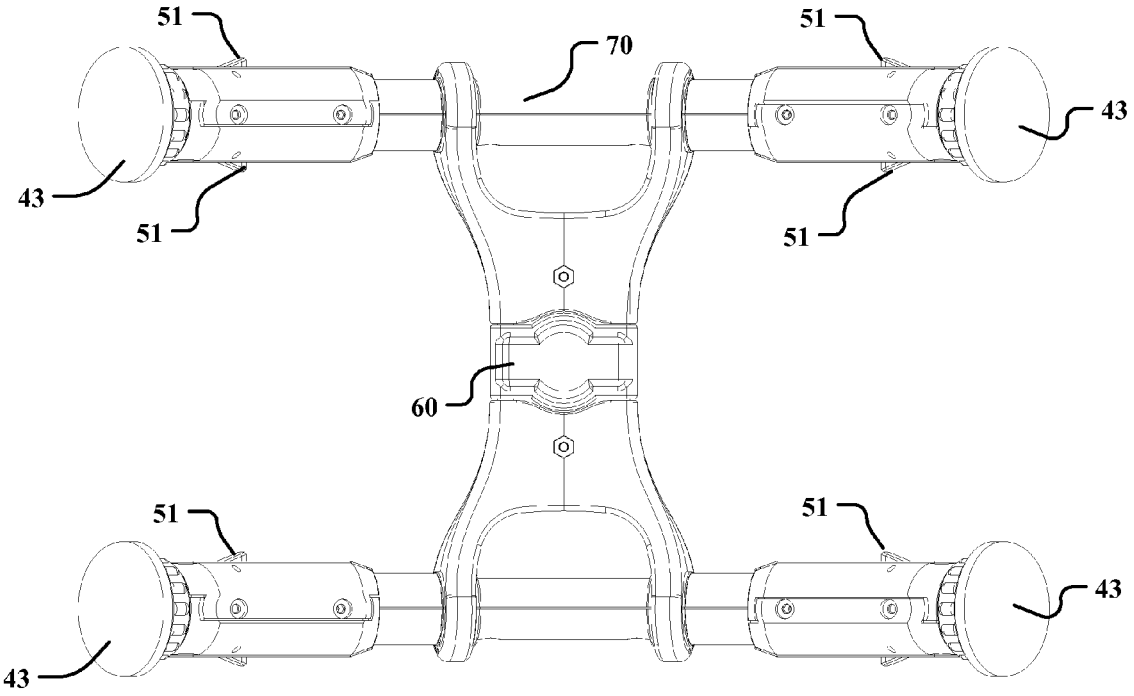
FIG. 3 is a diagram illustrating a bottom view of the exercise aid according to one embodiment of the invention.
Figure 4:
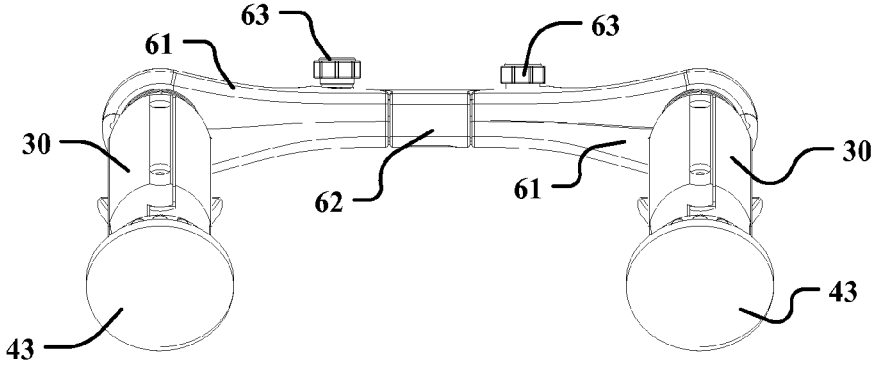
FIG. 4 is a diagram illustrating a front view of the exercise aid according to one embodiment of the invention.
Figure 5:
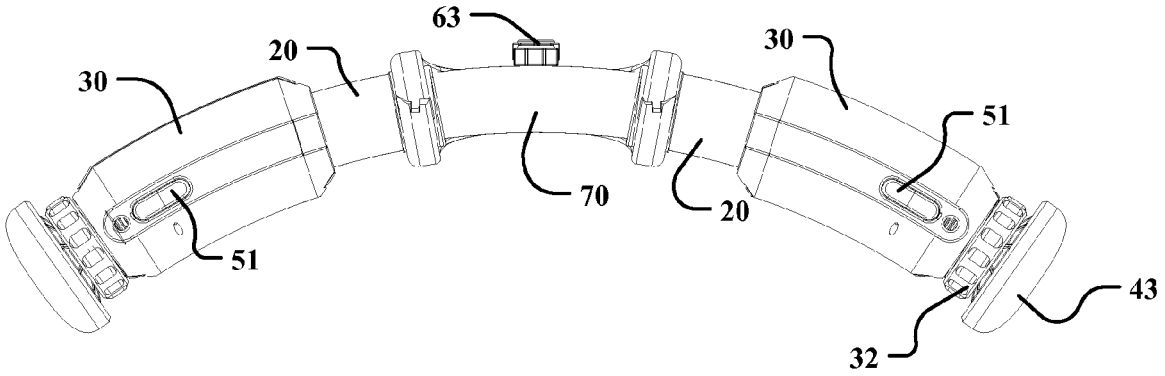
FIG. 5 is a diagram illustrating a side view of the exercise aid according to one embodiment of the invention.
Figure 6A:
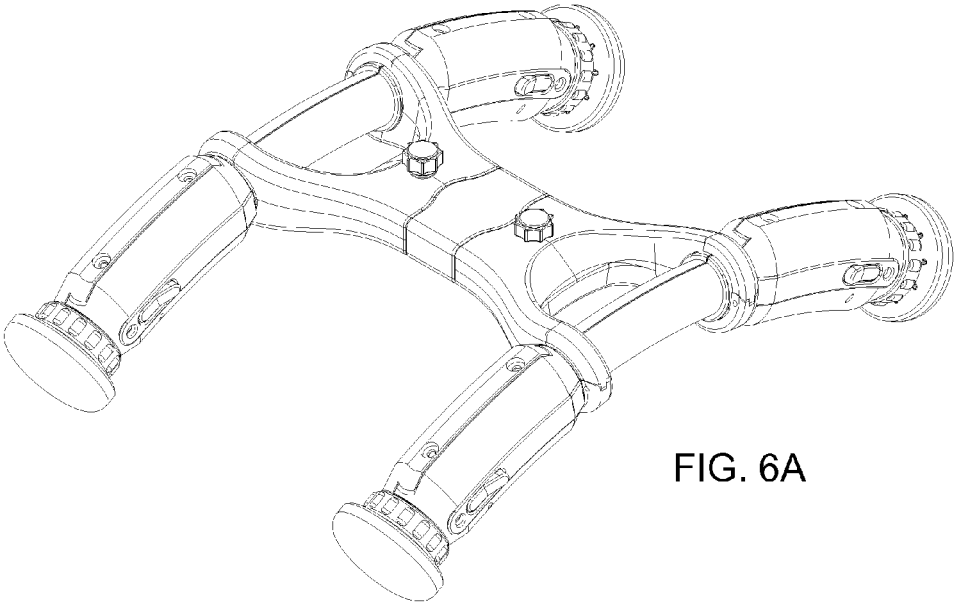
FIG. 6A is a diagram illustrating a front perspective view of the compressed exercise aid according to one embodiment of the invention.
Figure 6B:
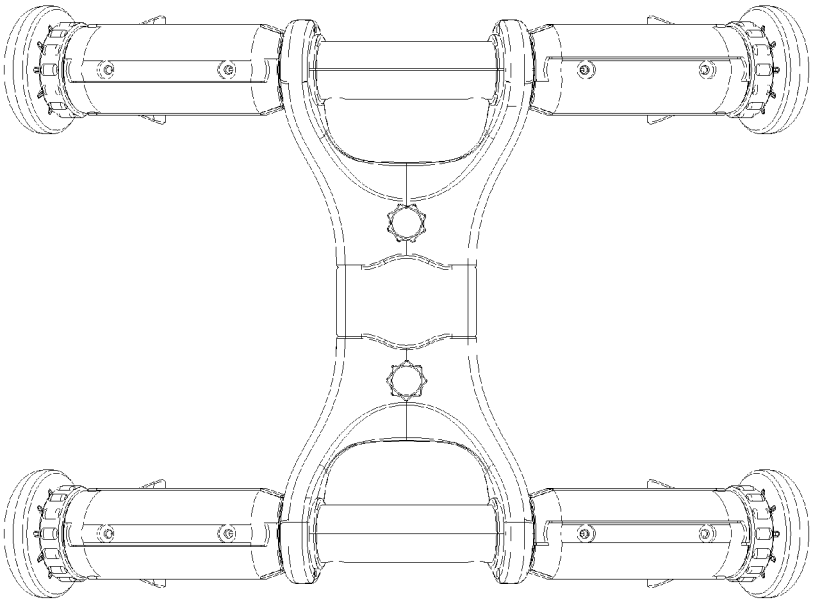
FIG. 6B is a diagram illustrating a top view of the compressed exercise aid according to one embodiment of the invention.
Figure 6C:
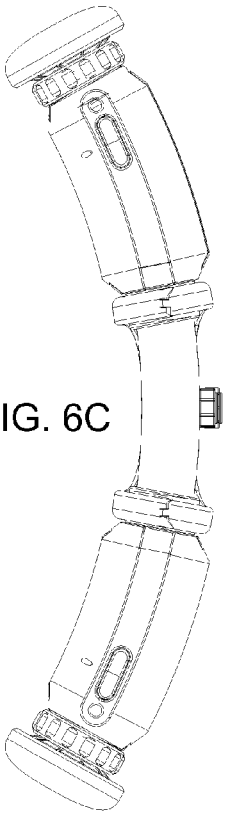
FIG. 6C is a diagram illustrating a side view of the compressed exercise aid according to one embodiment of the invention.
Figure 7A:
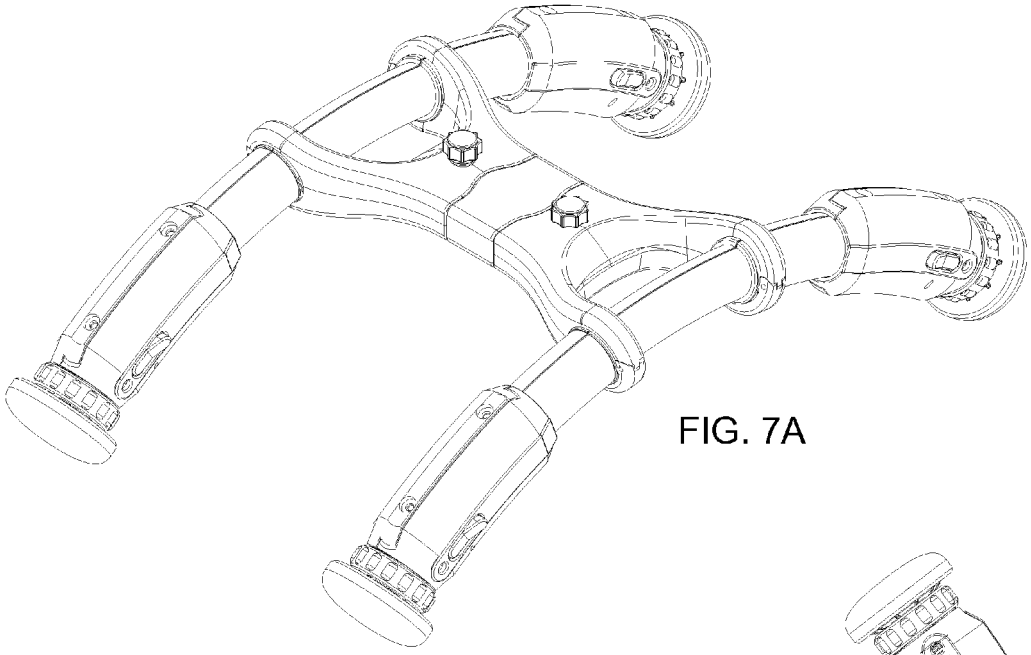
FIG. 7A is a diagram illustrating a front perspective view of the uncompressed exercise aid according to one embodiment of the invention.
Figure 7B:
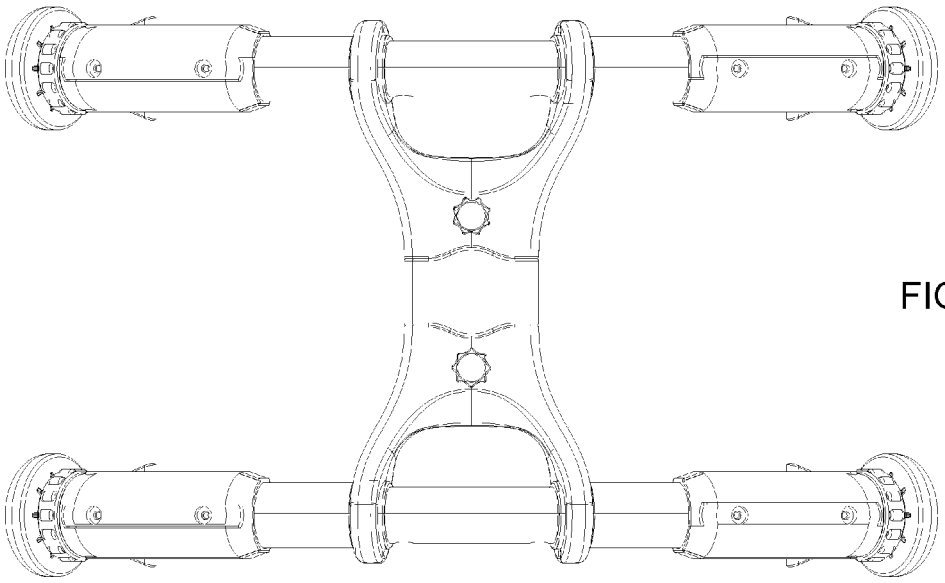
FIG. 7B is a diagram illustrating a top view of the uncompressed exercise aid according to one embodiment of the invention.
Figure 7C:
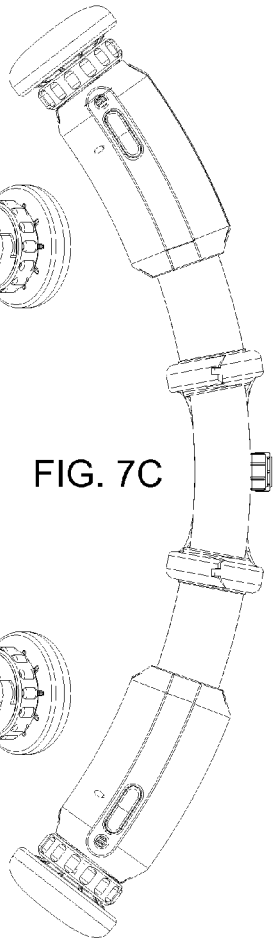
FIG. 7C is a diagram illustrating a side view of the uncompressed exercise aid according to one embodiment of the invention.
Figure 8A:
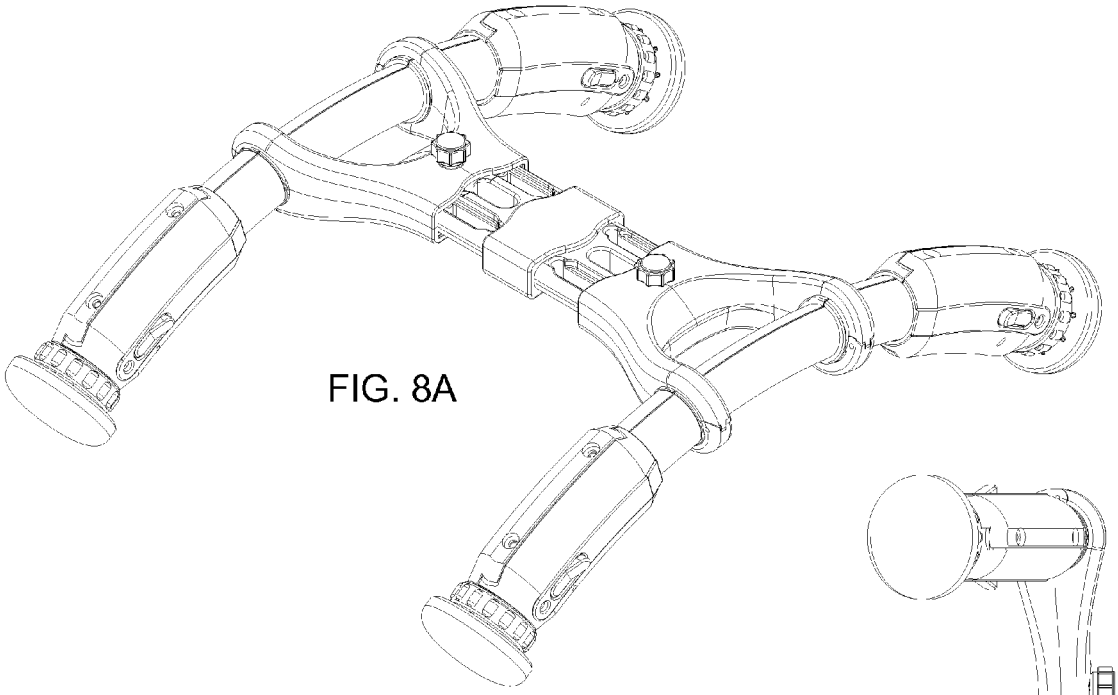
FIG. 8A is a diagram illustrating a front perspective view of the expanded exercise aid according to one embodiment of the invention.
Figure 8B:
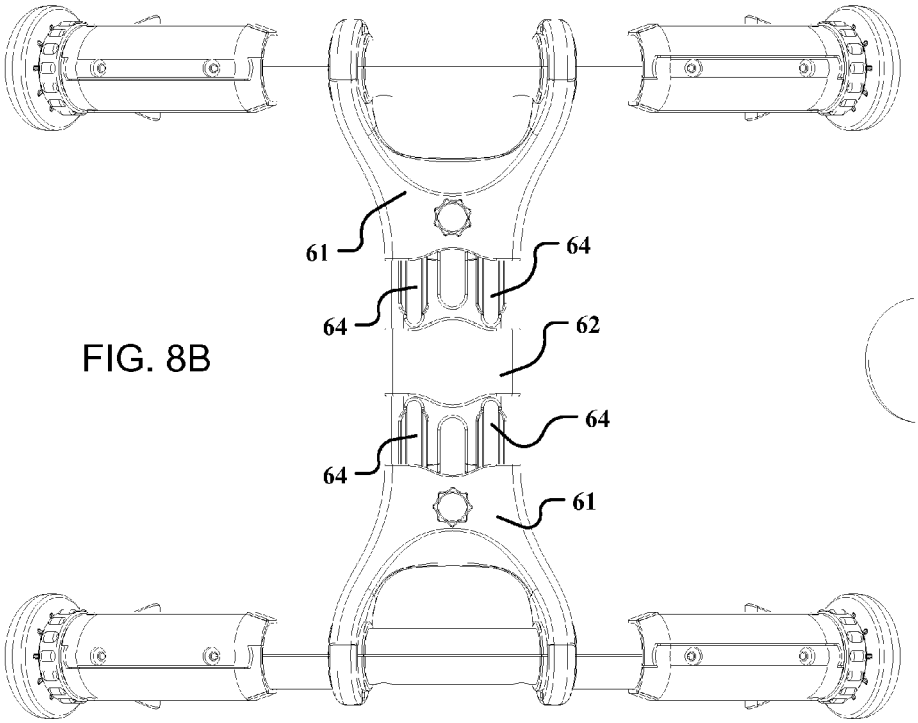
FIG. 8B is a diagram illustrating a top view of the expanded exercise aid according to one embodiment of the invention.
Figure 8C:
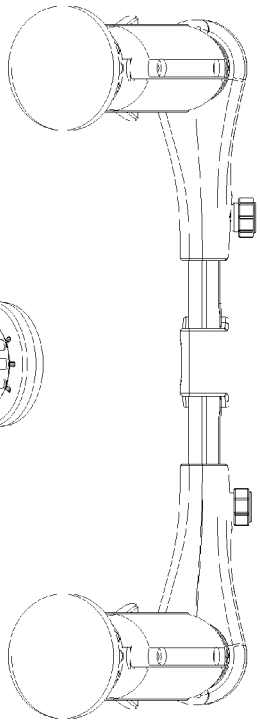
FIG. 8C is a diagram illustrating a side view of the expanded exercise aid according to one embodiment of the invention.
Figure 9:
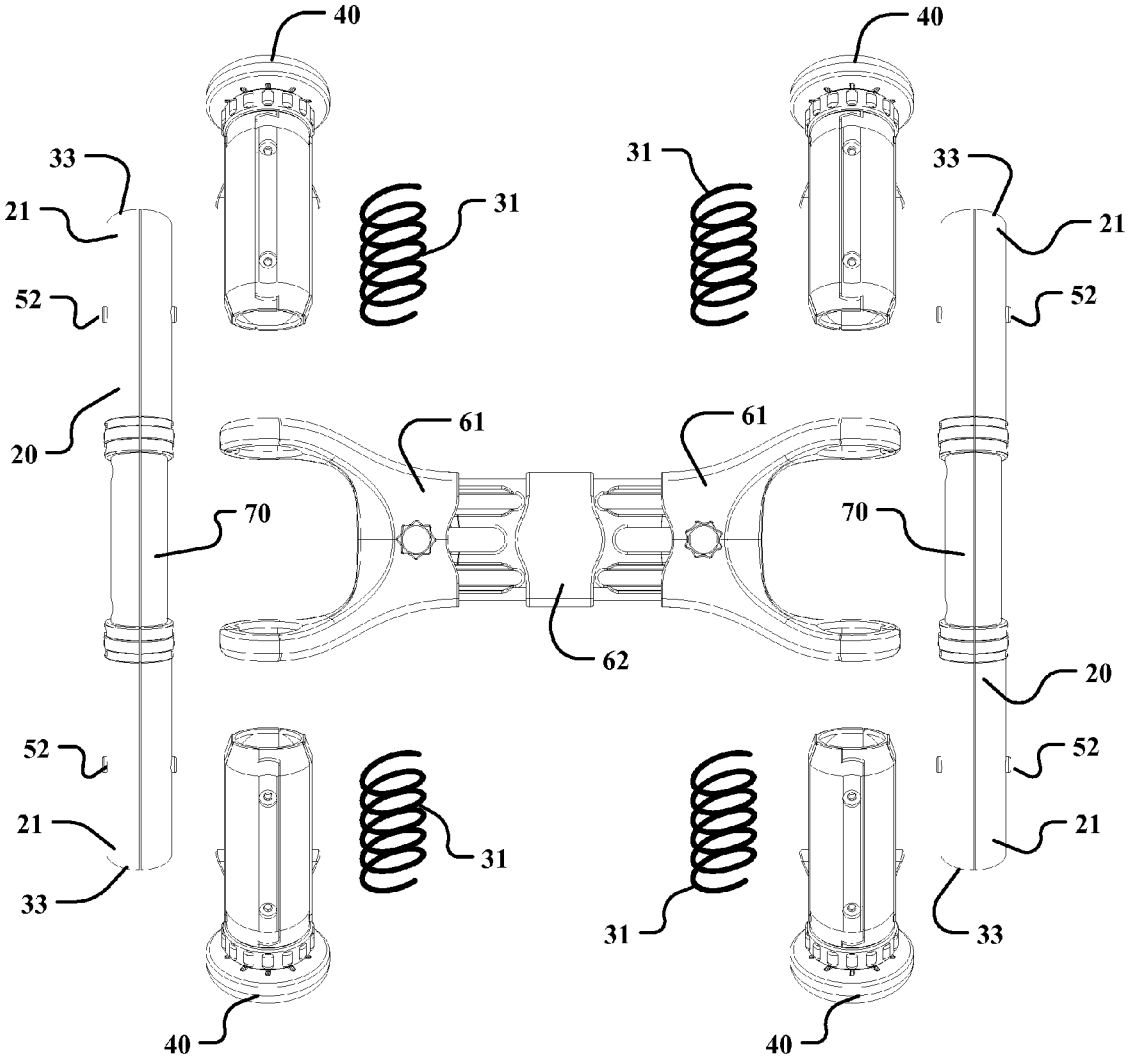
FIG. 9 is a diagram illustrating a top exploded view of the exercise aid according to one embodiment of the invention.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

The present invention 10 comprises a pair of arcuate tube housings 20 releaseably connected with a width-adjustment mechanism 60. The present invention 10 further comprises a plurality of compression mechanisms 30, one at each end 21 of the tube housings 20. The tube housings 20 are adapted to be placed between the chest and legs while the compression mechanisms 30 provide resistance during use.

The compression mechanisms 30 are responsible for providing outward force during use. Each compression mechanism 30 is mechanically attached at each tube housing end 21, for a total of four compression mechanisms 30. Each compression mechanism 30 further comprises a compression spring 31 to provide the resistance needed for this outward force, and an end cap 32 to retain the spring 31. More specifically, each spring 31 is contained within a recess 33 at each end 21 of the tube housings 20, and an end cap 32 is mechanically attached each end 21 of the tube housings 20 to secure each spring 31 in place. In the preferred embodiment, the tube housing ends 21 are outwardly threaded, while the end caps 32 are inwardly threaded. Each end cap 32 further comprises a plurality of protrusions to assist in gripping and rotating the end caps 32.

In the preferred embodiment, the spring 31 provides a fixed resistance. As such, the present invention 10 may be replaced with springs 31 of various resistances to provide a variety of workout intensities. Springs 31 are replaced by completely removing the end caps 32, releasing the springs 31 from the recesses 33. For easily identifying resistance levels, each spring 31 will have a color for easily determining which spring provides which desired resistance. For example, a green spring may be used for a low resistance, a yellow spring for a medium resistance, and a red spring for a high resistance. In an alternative embodiment, a spring aperture is positioned on the compression mechanism 30 to easily identify the color of the spring 31 being used. In a further alternative embodiment, a gas spring is used as opposed to a compression spring 31, wherein the gas spring is adapted to provide variable resistance when the gas pressure is increased or decreased.

A plurality of height-adjustment mechanisms 40 are rotatably attached to each compression mechanism 30. Each height-adjustment mechanism 40 further comprises a plunger 41 that is mechanically attached to the end cap 32 through a plunger aperture. In the preferred embodiment, the plunger 41 is outwardly threaded, while the plunger aperture is inwardly threaded. The springs 31 will provide resistance directly against the plungers 41. As such, the amount of resistance exerted by each height-adjustment mechanism 40 and plunger 41 will be determined by the resistance of the specific springs 31 within the compression mechanisms 30 in the device at the time of use.

Each height-adjustment mechanism 40 is adapted to adjust the overall height of the apparatus such that the plungers 41 rest on the body of the user comfortably. More specifically, the plungers 41 can be adjusted inward or outward from the compression mechanisms 30 to extend or contract the overall height of the device. This is accomplished by either unscrewing the plunger 41 from the end cap 32, increasing its distance from the compression mechanism 30, or screwing the plunger 41 into the end cap, decreasing its distance. Furthermore, the plungers 41 can be completely removed upon fully unscrewing them from the end caps 32. This permits the user to customize workouts by choosing to use less than all four of the compression mechanisms 30 at the same time.

A plurality of height-adjustment apertures 40 are positioned along the plungers 41, providing a visual aid when adjusting the height of the plungers 41. Here, the user will screw or unscrew each plunger 41 until the height-adjustment apertures 40 are consistent. In the preferred embodiment, the threading of the end cap 32 and plunger aperture operate such that an opposing direction is necessary to tighten or untighten each. In an alternative embodiment, tightening of the end caps 32 secures the plungers 41 in a fixed position, supporting the user's weight during workouts. Here, releasing the tension of the end caps 32 releases the plungers 41 for extending and contracting.

The locking mechanism 50 comprises opposing release buttons 51 positioned on each compression mechanism 30. The release buttons 51 are adapted to obstruct the movement of the compression mechanisms 30, preventing any force from being exerted and consequently locking the plungers 41 in a fixed position. This is accomplished by engaging the release buttons 51, which are mechanically attached to the compression mechanisms 30, with a pair of opposing lock protrusions 52 fixedly attached to the tube housings 20. When activated, the release buttons 51 will then prevent movement of the compression mechanisms 30 due to the attachment of the release buttons 51 to the opposing lock protrusions 52. In an alternative embodiment, only a single release button 51 and lock protrusion 52 are used, while an aperture is provided in the absent release button 51 to view the spring 31. In a further alternative embodiment, the locking mechanism 50 is also used to adjust the force exerted by the spring 31.

Each plunger 41 is in mechanical communication with the springs 31 of the compression mechanisms 30. As such, the user will apply bodily force against the plungers 41 in order to generate the resistance required during workouts. The plungers 41 further comprise pads 43 that provide support for the body parts in contact with the plungers 41 during use. Furthermore, each pad 43 comprises a viscid texture which will add grip when forced upon the body of the user. In the preferred embodiment, the pads 43 are made of a soft material such as silicone, although foam or other suitable materials may be used. In an alternative embodiment, the pads 43 are adapted to freely rotate in 360 degrees in a single plane perpendicular to the direction of force exerted by the compression mechanisms 30. In this embodiment, the present invention 10 is easily adjusted to the body of the user and provides additional safety and comfort due to the free-moving nature of the pads 43.

The width-adjustment mechanism 60 expands and contracts laterally to increase or decrease the distance between the tube housings 20. This allows the user to customize the displacement between the tube housings 20 for better placement on the chest and legs. Furthermore, the width-adjustment mechanism 60 can be contracted to minimize the size of the present invention 10 for storage purposes. The width-adjustment mechanism 60 comprises a pair of opposing cross braces 61, a center support 62, a pair of width-adjustment screws 63, and a width-adjustment track 64. The cross braces 61 are positioned around each tube housing 20, and are secured together with the center support 62.

To activate the width-adjustment mechanism 60, the width-adjustment screws 63 will be untightened, permitting the cross braces 61 and tube housings 20 to move along the width-adjustment track 64 and permitting expansion and contraction. The cross braces 61 are adapted to keep alignment within the width-adjustment tracks 64 so long as the width-adjustment screw 63 is not removed entirely. The width-adjustment mechanism 60 is further adapted to release the cross braces 61 from the center support 62 and the tube housings 20 from the width-adjustment mechanism 60. This is accomplished by removing the width-adjustment screws 63 completely from the width-adjustment track 64 and opening the cross braces 61 in a jaw-like manner, thereby detaching the tube housings 20 from the width-adjustment mechanism 60. As such, each tube housing 20 can be released and used individually for certain exercises that may require the use of only one the tube housing 20 at a time, or for storage purposes.

The cross braces 61 are made of a durable material, while the center support 62 is made from a firm, yet flexible material adapted to provide a less-rigid structure. In other words, the center support 62 is adapted to be flexible and provide flexibility between the tube housings 20 for further adjustability between exercises and body types. Each cross-brace 61 further comprises a protrusion at its hinge point, adapted to lock itself with the tube housings 20, and a plurality of teeth adapted to grip the center support 62 when closed. Therefore, the cross-members 61 will remain secure and in a perpendicular orientation at all times. In the preferred embodiment, the center support 62 can be adjusted in a 90 degree range)(+45°/−45°.

A plurality of grips 70 are positioned at the center of the tube housings 20. The grips 70 allow the user to grasp the tube housings 20 for positioning before use and to generate extra force during use. In the preferred embodiment, the grips 70 are positioned between the cross braces 61 and comprise a viscid material with a texturized surface for improved grip. Alternatively, a gel-based substance, foam, or other comfortable, yet durable, material can be used. In an alternative embodiment, a pair of handles (not shown) are externally attached to the tube housings 20 and replace the grips 70 to allow the user to support the device and generate additional force.

Before use, the present invention 10 must be adjusted such that it will fit comfortably on the chest and legs of the user. First, the user must adjust the width of the tube housings 20 with the width-adjustment mechanism 60. The user will adjust the width by unscrewing the width-adjustment screws 63 and extending or contracting the cross braces 61 and tube housings 20 along the width-adjustment track 64. Next, the user must adjust the height of the plungers 41 with the height-adjustment mechanism 40. The user will adjust the plungers 41 by unscrewing or screwing them from the end cap 32, thereby extending or contracting the plungers 41 until they rest comfortably on the chest and legs. Lastly, the user must select the appropriate resistance level by replacing the springs 31 in the compression mechanisms 30. Resistance level is adjusted by removing the end caps 32 and exchanging the springs 31 within the recesses 33 with springs 31 having a desired resistance level.

For advanced customization, the user may lock one or more plungers 41 by activating the locking mechanism 50, preventing the corresponding plunger 41 from receiving outward force from the corresponding compression mechanism 30. This can be advantageous for injured users who are only able to exercise specific parts of their body or for cross-body exercises. Furthermore, the user may use a tube housing 20 individually by releasing the tube housing 20 from the width-adjustment mechanism 60 with the width-adjustment screw 63. This is advantageous for isolating a muscle group during exercise.

Once the present invention 10 is adjusted to the specifications of the user, it is ready for use as an exercise aid. One example includes using the present invention 10 for abdominal exercises, performed while sitting in a chair, lying on a half-ball, or lying on a mat. First, the user will grasp the present invention 10 with the grips 70 and place the plungers 41 and pads 43 against their chest and legs. Next, the user will bring their chest towards their legs, exerting force upon the compression mechanisms 30. The compression mechanisms 30 will provide resistance to this motion by returning a force commensurate with the resistance level of the springs 31. While this is an exemplary exercise, the adjustability and customization of the present invention 10 will provide many useful exercises and workouts for the user.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An exercise device, comprising:

a pair of arcuate tube housings, each arcuate from a first end to a second end;

a plurality of compression mechanisms positioned at the ends of said pair of tube housings, wherein said plurality of compression mechanisms are individually configurable;

a plurality of height-adjustment mechanisms releasably connected to said compression mechanisms;

a width-adjustment mechanism releasably connected to said pair of tube housings, wherein said width-adjustment mechanism is positioned between said pair of arcuate tube housings and is configured to adjust the width between said arcuate tube housings;

wherein said pair of tube housings are adapted to be placed between the chest and legs while said compression mechanisms provide resistance during use.

2. An exercise device according to claim 1, wherein said pair of arcuate tube housings further comprise a plurality of recesses at each tube housing end.

3. An exercise device according to claim 2, wherein said plurality of compression mechanisms further comprise a plurality of springs having a fixed resistance.

4. An exercise device according to claim 3, wherein said plurality of compression mechanisms further comprise a plurality of end caps mechanically attached to said compression mechanisms and adapted to retain said springs within said recesses of said arcuate tube housings.

5. An exercise device according to claim 4, wherein said plurality of end caps further comprise a threaded attachment, wherein removal of said end caps releases said plurality of springs, and wherein said springs can be replaced for alternative springs having different resistances.

6. An exercise device according to claim 5, wherein said springs having different resistances further comprise different colors corresponding with said different resistances.

7. An exercise device according to claim 4, wherein said plurality of height-adjustment mechanisms each further comprise a plunger in mechanical communication with said springs.

8. An exercise device according to claim 7, wherein said plunger is mechanically attached to said end caps such that unscrewing said plunger will increase the displacement between said plunger and said compression mechanism, and screwing said plunger will decrease the displacement between said plunger and said compression mechanism, allowing said plunger to be extended or contracted such that said plunger fits comfortably on the chest and legs of the user.

9. An exercise device according to claim 8, wherein said plunger can be unscrewed and removed from said compression mechanism.

10. An exercise device according to claim 7, wherein said plunger further comprises a pad comprising a soft material having a viscid texture which will add grip when forced upon the body of the user.

11. An exercise device according to claim 1, wherein said pair of arcuate tube housings further comprise a plurality of lock protrusions, wherein a plurality of release buttons are positioned on said compression mechanisms corresponding with said lock protrusions such that, when depressed, they obstruct the movement of the compression mechanisms.

12. An exercise device according to claim 1, wherein said width-adjustment mechanism further comprises a pair of opposing cross braces frictionally attached to a center support, wherein release of a width-adjustment screw permits said cross braces to expand and contract along a width-adjustment track.

13. An exercise device according to claim 12, wherein said pair of opposing cross braces are adapted to open in a jaw-like manner when said width-adjustment screw is fully removed, permitting said pair of arcuate tube housings to be used individually.

14. An exercise device according to claim 12, wherein said center support is adapted to permit movement between said pair of arcuate tube housings in a 90 degree range (+45°/−45°).

15. An exercise device according to claim 12, further comprising a plurality of grips positioned on said arcuate tube housings between said opposing cross braces.

16. A method of using an exercise device, comprising:

adjusting the width of a pair of tube housings, each arcuate from a first end to a second end;

adjusting the resistance of a plurality of compression mechanisms attached to said tube housings, wherein said plurality of compression mechanisms are individually configurable;

adjusting the height of a plurality of plungers mechanically attached to said compression mechanisms;

wherein the width and height are adjusted such that said plungers rest comfortably on the chest and legs of the user.

17. The method of claim 16, wherein said width is adjusted by releasing a width-adjustment screw such that a pair of opposing cross braces may freely move along a width-adjustment track.

18. The method of claim 16, wherein said resistance is adjusted by releasing an end cap mechanically attached to said compression mechanisms and replacing a spring having a fixed resistance with an alternative spring having a different, fixed resistance.

19. The method of claim 18, wherein said height is adjusted by releasing a plunger mechanically attached to said end cap and in mechanical communication with said spring.

20. The method of claim 16, wherein said device is positioned between the chest and legs of the user, and wherein the device provides resistance when compressed against the chest and legs of the user.

* * * * *